US006450879B1

(12) United States Patent
Suen

(10) Patent No.: US 6,450,879 B1
(45) Date of Patent: Sep. 17, 2002

(54) AIR CURTAIN GENERATOR

(75) Inventor: Yeong-Nian Suen, Taichung (TW)

(73) Assignees: Yeong-Nian Suen, Taichung (TW); Shing-Chyong Fwu, Taichung (TW)

( * ) Notice: Subject to any disclaimer, the term of this patent is extended or adjusted under 35 U.S.C. 154(b) by 0 days.

(21) Appl. No.: 09/984,096

(22) Filed: Oct. 29, 2001

(51) Int. Cl.[7] ..... F24F 9/00

(52) U.S. Cl. ..... 454/188; 126/299 D; 454/66; 454/191; 454/192

(58) Field of Search ..... 454/50, 56, 63, 454/66, 188, 189, 190, 191, 193, 192; 126/299 R, 299 D

(56) References Cited

U.S. PATENT DOCUMENTS 3,362,469 A * 1/1968 Berner et al. ..... 165/122

4,037,079 A * 7/1977 Armbruster ..... 219/203

FOREIGN PATENT DOCUMENTS

FR 2 308 872 * 11/1976 ..... 454/188

* cited by examiner

*Primary Examiner*—Harold Joyce
(74) *Attorney, Agent, or Firm*—Rosenberg, Klein & Lee

(57) ABSTRACT

An air curtain generator includes a casing with a fan received therein so as to blow an air curtain from opening of the casing. Two arms are pivotally connected to two end members on two ends of the casing. and each arm is pivotally connected to a fixed member. A link is pivotally connected between the fixed member and the end member so that the casing is able to be adjusted by pivoting the arms. The air curtain separates the workers and the source where generates contaminated air.

5 Claims, 10 Drawing Sheets

AIR CURTAIN GENERATOR

FIELD OF THE INVENTION

The present invention relates to an air curtain generator that forms an air curtain between the workers and the working site so as to prevent the workers from inhaling contaminated air.

BACKGROUND OF THE INVENTION

Some working places generate contaminated air such as in the kitchens or welding plants where the air contains several particles such as oil particles and/or chemical particles. The workers have to stay there so that they cannot avoid from inhaling the contaminated air which is not good for their health. The kitchen range hood is used to suck the smoke which is generated during the process of heating food. However, the position of the range hood is difficult to suck the smoke completely so that the users still inhale the smoky air. The workers in welding plants are exposed in dangerous circumstances because the air in the plants contains of metal particles and chemical particles.

SUMMARY OF THE INVENTION

In accordance with one aspect of the present invention, there is provided an air curtain generator which comprises a casing having a fan received therein and the fan blows air through a plurality of openings defined through the casing. An end member is connected to the casing and a link has a first end pivotally connected to the end member. An arm has a first end pivotally mounted to the end member and a second end of the arm is pivotally connected to a fixed member. A rod extends from the fixed member and is pivotally connected to a second end of the link.

The primary object of the present invention is to provide an air curtain generator that forms an air curtain between the workers and a source of the contaminated air.

The other object of the present invention is to employ the air flow of the air curtain to guide the smoke toward a kitchen range hood.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
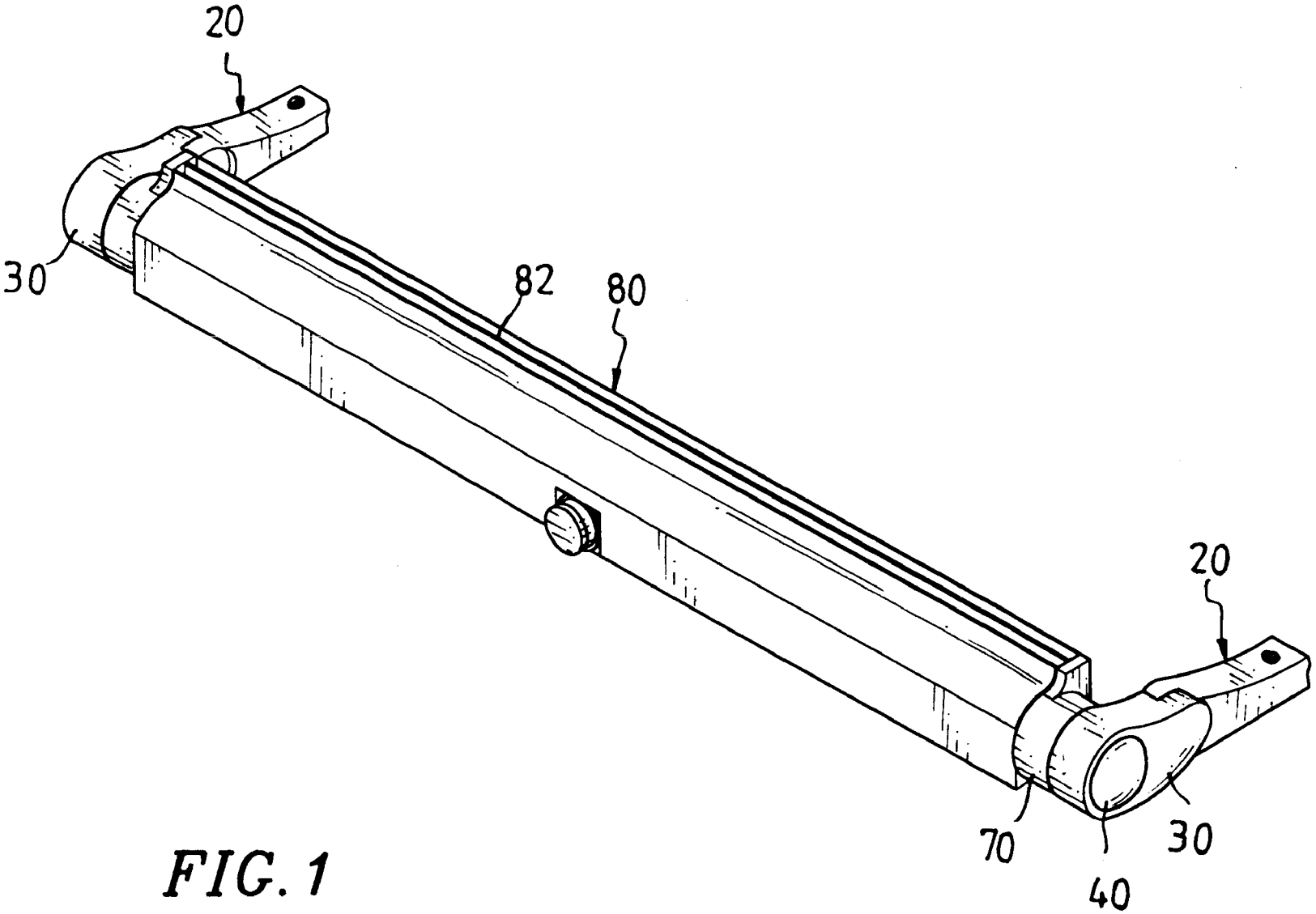
FIG. 1 is a perspective view to show the air curtain generator of the present invention.
Figure 2:
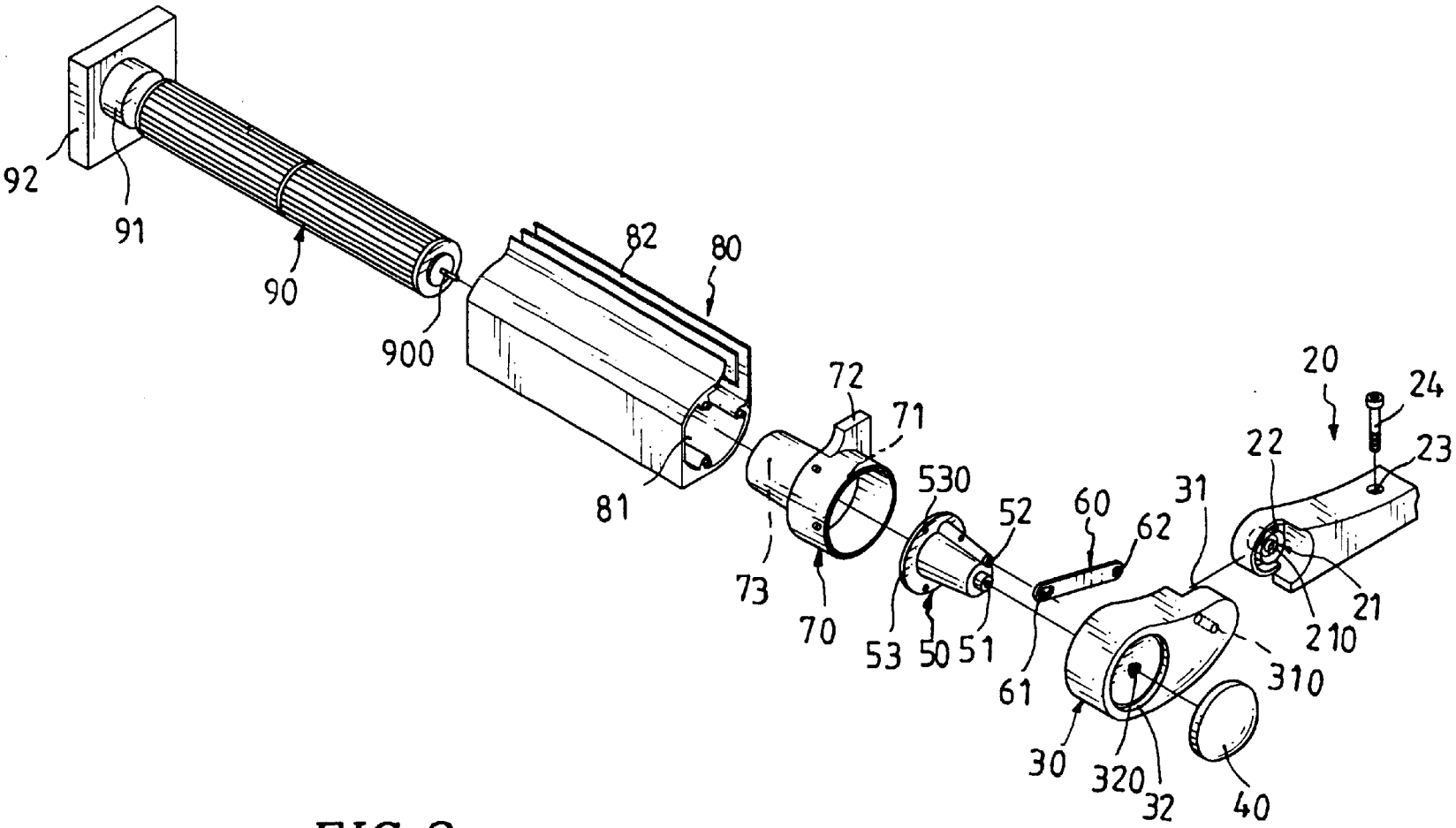
FIG. 2 is an exploded view to show the air curtain generator of the present invention.

Referring to FIGS. 1, 2, 4 and 5, the air curtain generator of the present invention comprises a casing 80 having two fans 90 received therein and the fans 90 each are driven by a motor 91 which is connected to a motor frame 92. A plurality of openings 82 are defined through the casing 80 so that the fans 90 blows air flow through the openings 82. Two sleeves 70 are respectively engaged with two ends 81 end of the casing 80 and each sleeve 70 has a position hole 73 defined through a close end thereof. Each of the fans 90 has an axle and an end piece 900 extends from the axle. The end piece 900 is inserted in the position hole 73. Each sleeve.70 has a protrusion plate 72 for sealing the openings 82 at each end of the casing 80.

An end member 50 is connected to each of the sleeves 70 and has a flange 53 on an end thereof. The flange 53 is fixed to the sleeve 70 by snapping a resilient pin 71 extending from the sleeve 70 with the hole 530 in the flange 53. Each of the end members 50 has a position protrusion 51 extending from a center of an end of the end member 50 and a side member 52 located on the end member 50. A link 60 has a first end 61 pivotally connected to the side member 52 and an arm 30 has a first end pivotally mounted to the end member 50. A second end of the arm 30 is pivotally connected to a fixed member 20. The arm 30 has a hole 320 defined in the first end thereof and the position protrusion 51 is rotatably engaged with the hole 320. A recess 32 is defined in an outside of the first end of the arm 30 so as to receive a cap 40 therein. The fixed member 20, has a recess 210 and an extension 31 extends from the second end of the arm 30, the extension 31 is engaged with the recess 210. A pin 310 extends from the extension 31 on the second end of the arm 30 and is engaged with the recess 210 of the fixed member 20. A rod 22 extends from the fixed member 20 and is pivotally connected to a second end 62 of the link 60.

Figure 3:
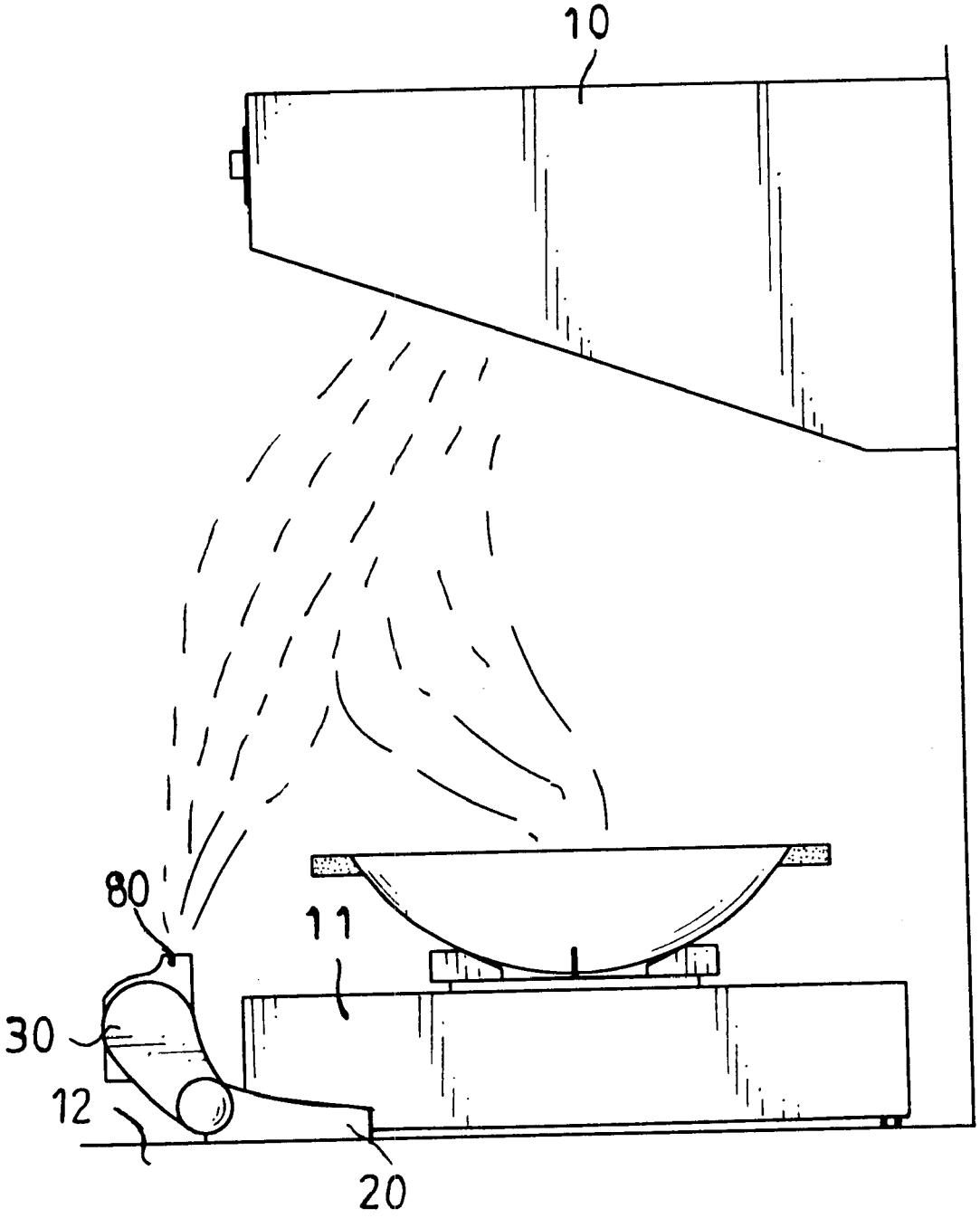
FIG. 3 is a side illustration view to show how the air curtain generator of the present invention to guide the smoke toward a range hood.
Figure 4:
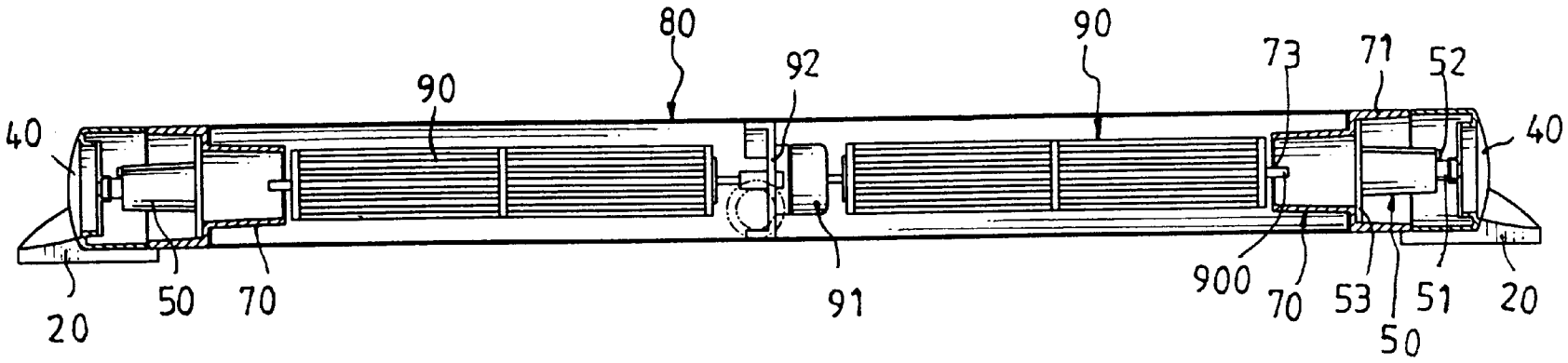
FIG. 4 shows the parts composing the air curtain generator of the present invention.
Figure 5:
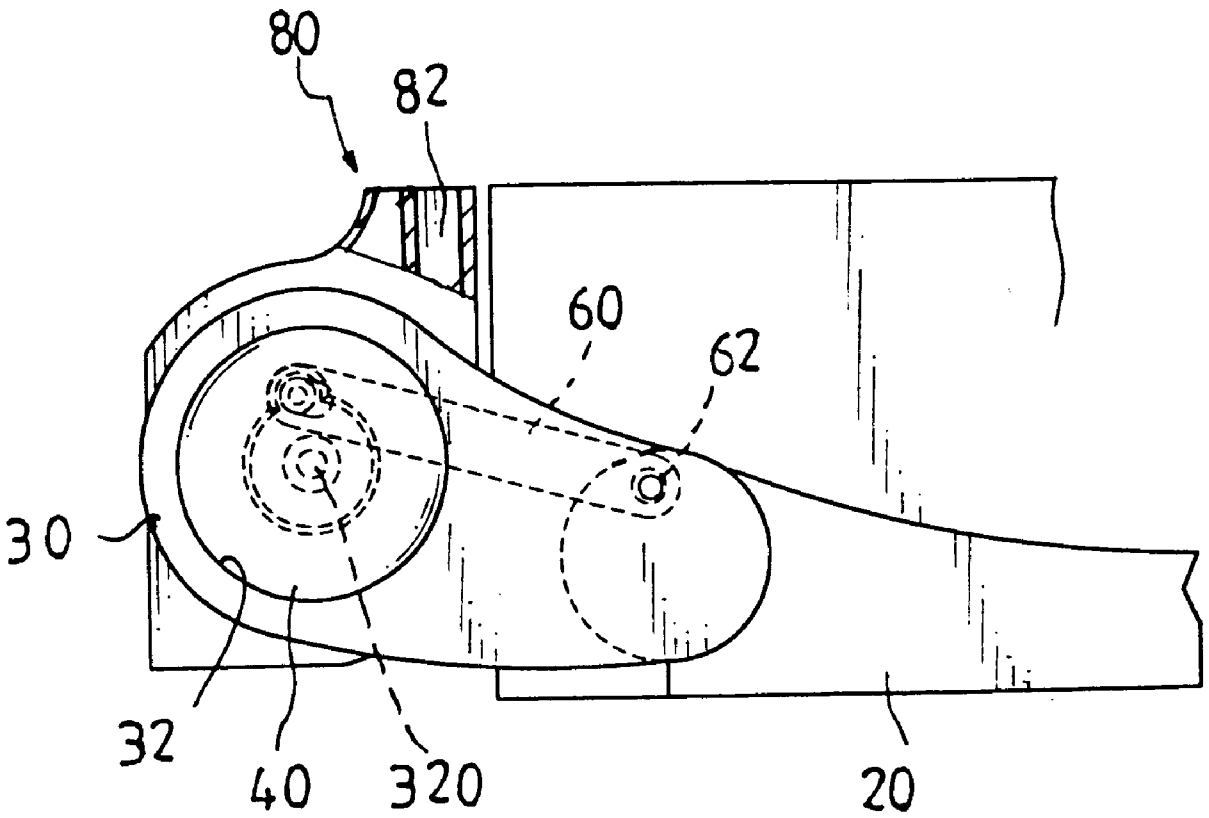
FIG. 5 is a side view to show the, air curtain generator of the present invention.
Figure 8:
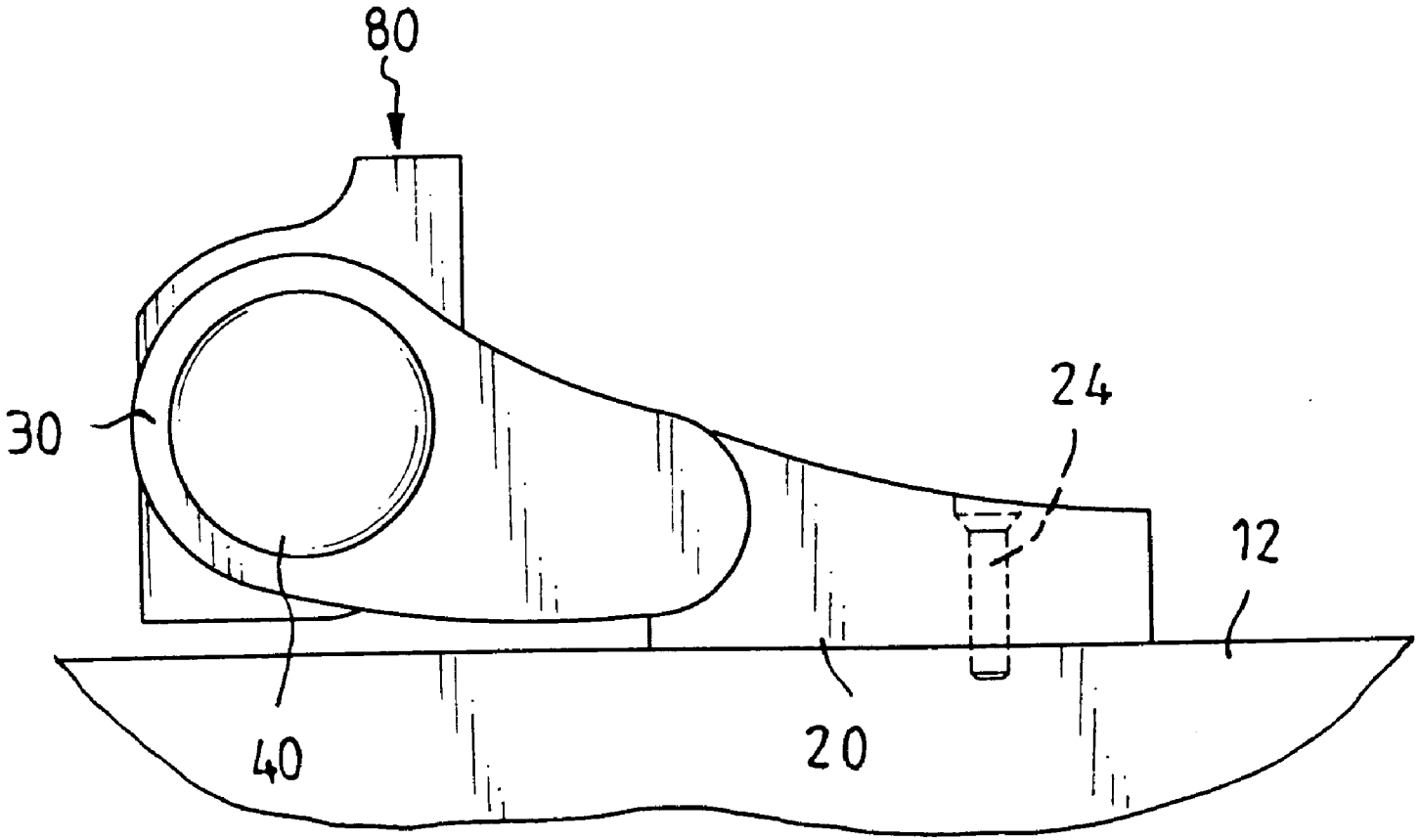
FIG. 8 shows a bolt is used to fix the fixed member of the air curtain generator of the present invention.

Referring to FIGS. 3, 5 and 8, the two fixed members 20 are fixed to a work top 12 by using a bolt 24 extending through a hole 23 in the fixed member 20 and engaged with the work top 12 to position the air curtain generator. The air flow forms an air curtain between the stove 11 and the users so that the contaminated smoke or air will not reach the users. Besides, as shown in FIG. 3, the air flow will guide the contaminated smoke or air toward the kitchen range hood 10 so as to increase the efficiency of sucking of the contaminated smoke or air.

Figure 6:
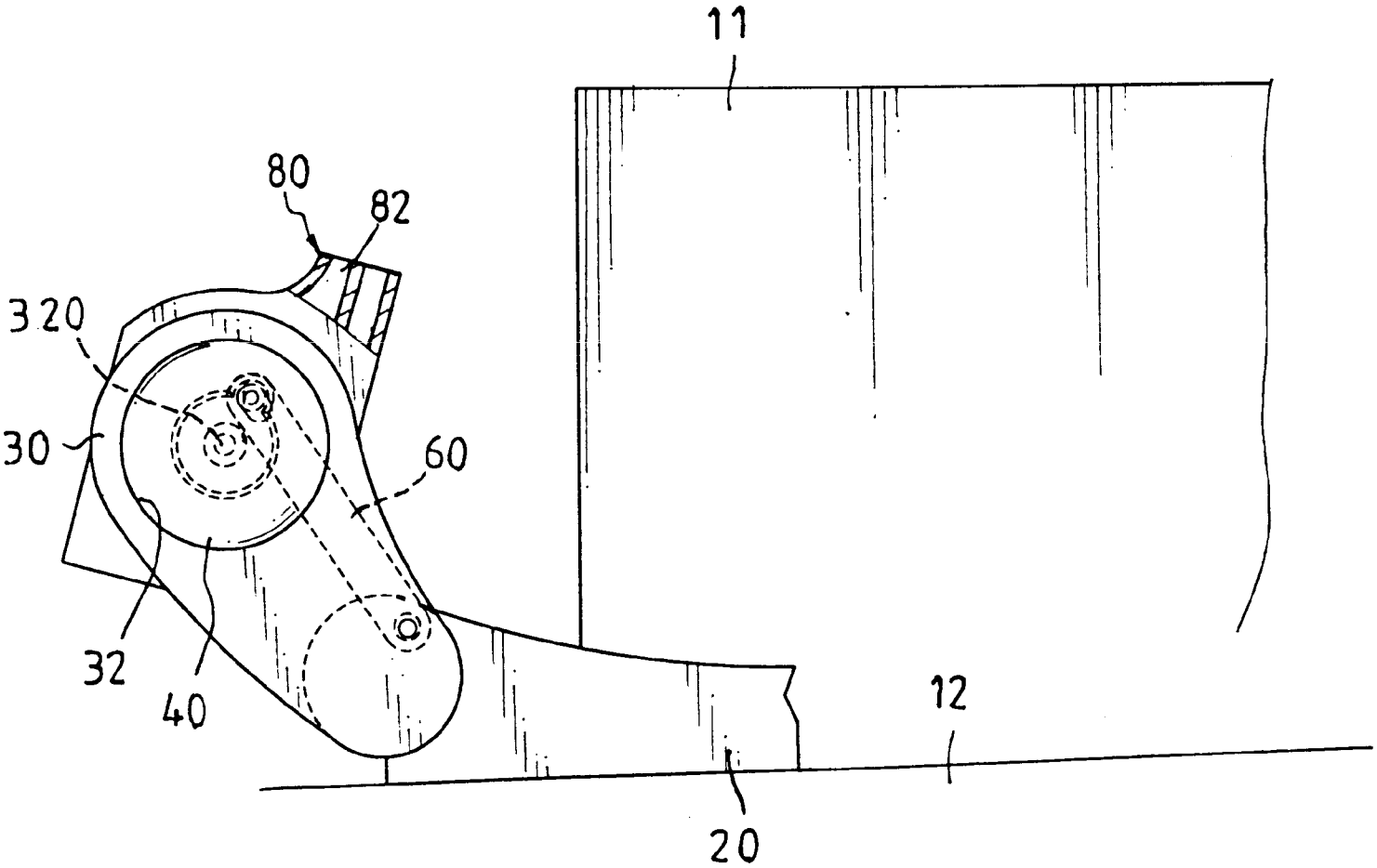
FIG. 6 is a side view to show the air curtain generator of the present invention is pivoted an angle.
Figure 7:
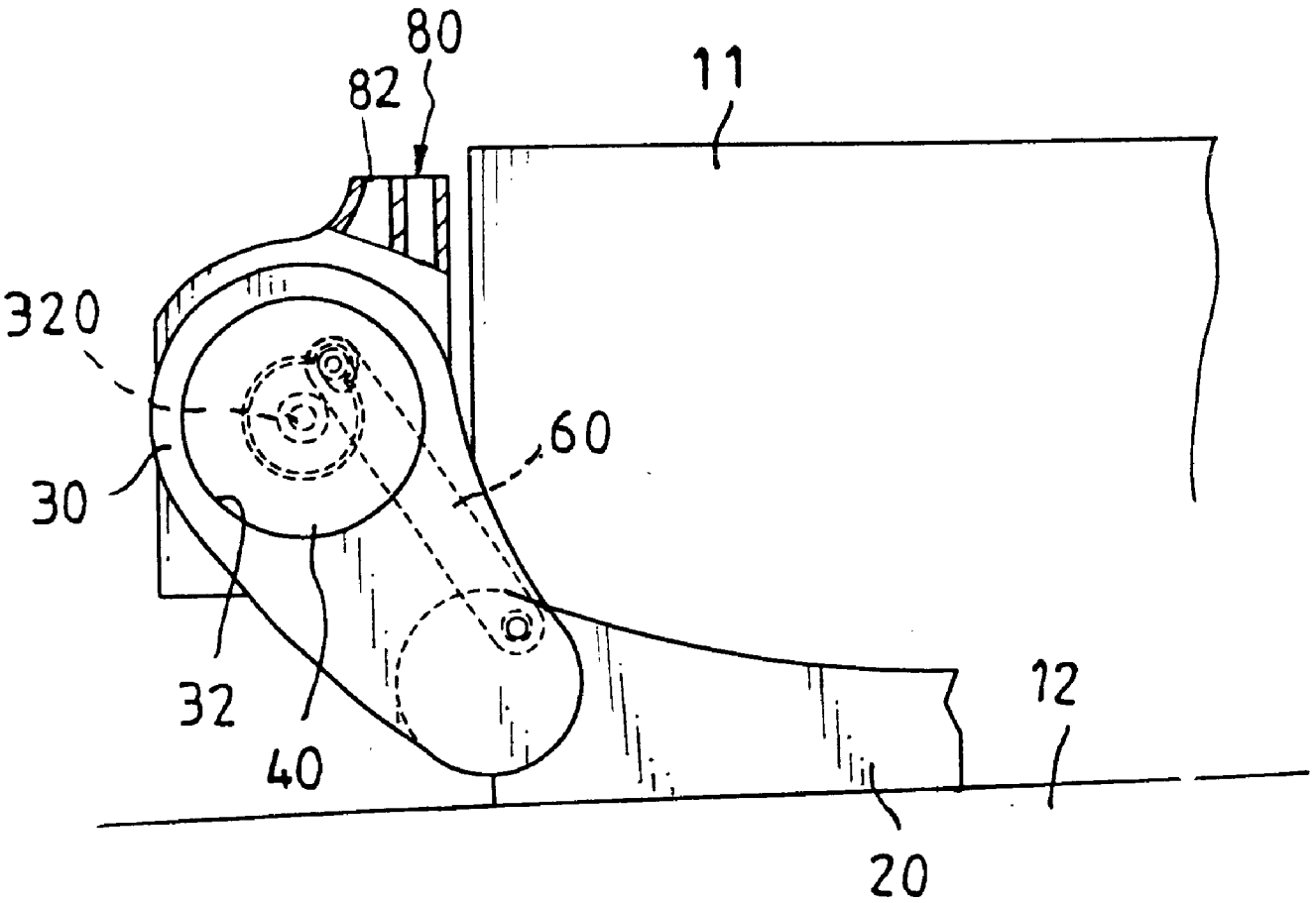
FIG. 7 is a side view to show that the air curtain generator of the present invention is pivoted to another angle.

As shown in FIGS. 6 and 7, the users may pivot the casing 80 to a desired position and the arms 30 are pivoted about the two respective pins 310 on the arms 30. The links 60 maintain the position of the casing 80 so that the casing 80 can be held at its position.

Figure 9:
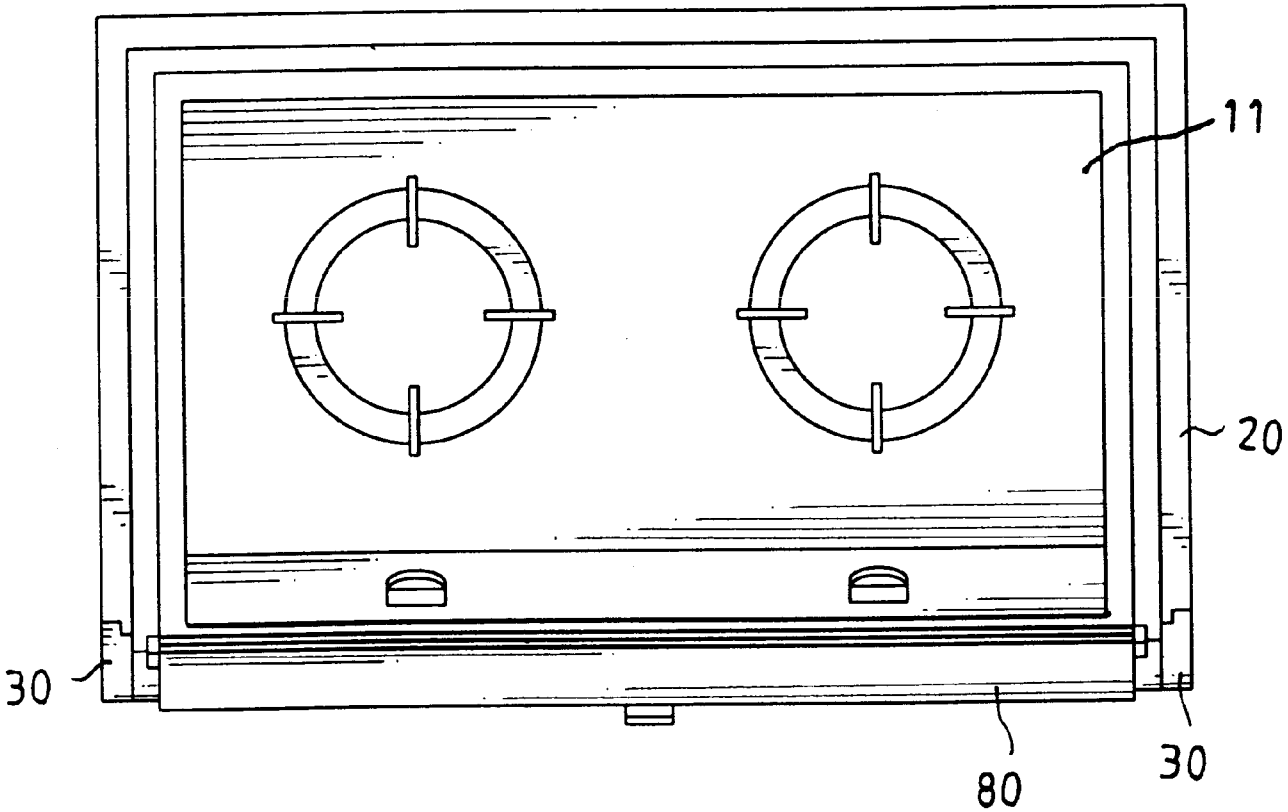
FIG. 9 is a top view to show an arrangement of the air curtain generator of the present invention.
Figure 10:
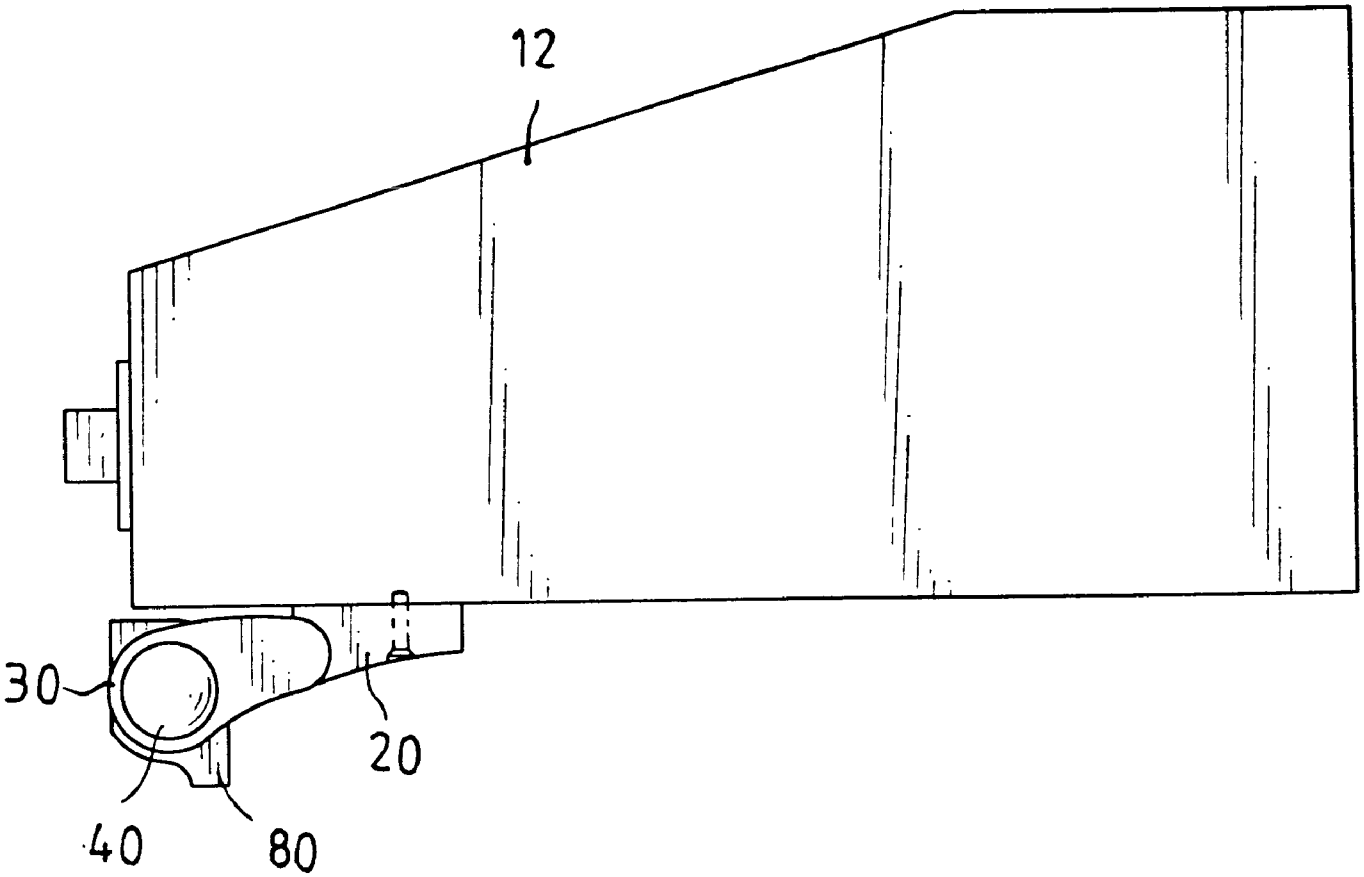
FIG. 10 is a side view to show another arrangement of the air curtain generator of the present invention.

FIG. 9 shows that the air curtain generator is arranged at a front end of the stove 11 and FIG. 10 shows that the air curtain generator is directly connected to a bottom of the kitchen range hood 12.

While we have shown and described the embodiment in accordance with the present invention, it should be clear to those skilled in the art that further embodiments may be made without departing from the scope of the present invention.

What is claimed is:

1. An air curtain generator comprising:

a casing having a fan received therein and a motor connected to an end of said fan, said motor driving said fan and a plurality of openings defined through said casing, and an end member connected to said casing and a link having a first end pivotally connected to said end member, an arm having a first end pivotally mounted to said end member and a second end of said arm pivotally connected to a fixed member, a rod extending from said fixed member and pivotally connected to a second end of said link.

2. The air curtain generator as claimed in claim 1, wherein said fixed member has a recess and a pin extends from said second end of said arm, said pin engaged with said recess of said fixed member.

3. The air curtain generator as claimed in claim 1, wherein said end member has a position protrusion and said arm has a hole defined in said first end thereof, said position protrusion rotatably engaged with said hole.

4. The air curtain generator as claimed in claim 1 further comprising a sleeve engaged with an end of said casing and said sleeve having a position hole defined through a close end thereof, said fan having an axle and an end piece extending from said axle, said end piece inserted in said position hole.

5. The air curtain generator as claimed in claim 4 wherein said end member has a flange on an end thereof and said flange is fixed to said sleeve.

* * * * *